US007101243B2

(12) United States Patent
Amey, Jr.

(10) Patent No.: US 7,101,243 B2
(45) Date of Patent: Sep. 5, 2006

(54) FIELD EMITTER CATHODE BACKPLATE STRUCTURES FOR DISPLAY PANELS

(75) Inventor: Daniel Irwin Amey, Jr., Hockessin, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 10/636,138

(22) Filed: Aug. 7, 2003

(65) Prior Publication Data

US 2004/0027053 A1 Feb. 12, 2004

Related U.S. Application Data

(63) Continuation of application No. 09/381,540, filed as application No. PCT/US98/05543 on Mar. 19, 1998, now abandoned.

(60) Provisional application No. 60/041,696, filed on Mar. 25, 1997.

(51) Int. Cl.
*H01J 9/00* (2006.01)
*H01J 9/04* (2006.01)

(52) U.S. Cl. ..... 445/24; 216/11; 216/23; 445/50; 445/51

(58) Field of Classification Search ..... 445/13, 445/17, 62, 87, 95, 24, 25
See application file for complete search history.

(56) References Cited

U.S. PATENT DOCUMENTS

| | | | |
|---|---|---|---|
| 4,598,037 A | 7/1986 | Felten | |
| 4,726,877 A | 2/1988 | Fryd et al. | |
| 4,752,531 A | 6/1988 | Steinberg | |
| 4,753,865 A | 6/1988 | Fryd et al. | |
| 4,857,799 A | 8/1989 | Spindt et al. | |
| 4,908,296 A | 3/1990 | Nebe et al. | |
| 4,912,019 A | 3/1990 | Nebe et al. | |
| 4,925,771 A | 5/1990 | Nebe et al. | |
| 4,959,295 A | 9/1990 | Nebe et al. | |
| 5,015,912 A | 5/1991 | Spindt et al. | |
| 5,032,216 A | 7/1991 | Felten | |
| 5,032,478 A | 7/1991 | Nebe et al. | |
| 5,032,490 A | 7/1991 | Nebe et al. | |
| 5,035,980 A | 7/1991 | Nebe et al. | |
| 5,047,313 A | 9/1991 | Nebe et al. | |
| 5,209,814 A | 5/1993 | Felten et al. | |
| 5,260,163 A | 11/1993 | Nebe et al. | |
| 5,275,689 A | 1/1994 | Felten et al. | |
| 5,306,756 A | 4/1994 | Felten et al. | |
| 5,385,631 A | 1/1995 | Tamemasa et al. | |
| 5,496,200 A | 3/1996 | Yang et al. | |
| 5,578,901 A | 11/1996 | Blanchet-Fincher et al. | |
| 5,601,966 A * | 2/1997 | Kumar et al. | 216/41 |
| 6,228,465 B1 * | 5/2001 | Takiguchi et al. | 430/18 |

FOREIGN PATENT DOCUMENTS

| | | |
|---|---|---|
| EP | 0 742 572 A2 | 11/1996 |
| EP | 0 742 585 A1 | 11/1996 |
| EP | 0 828 291 A2 | 3/1998 |
| WO | WO 94/15350 | 7/1994 |
| WO | WO 94/15352 | 7/1994 |
| WO | WO 94/18694 | 8/1994 |
| WO | WO 94/28571 | 12/1994 |
| WO | WO 97/07524 | 2/1997 |

* cited by examiner

*Primary Examiner*—Mariceli Santiago

(57) ABSTRACT

Multilayer cathode backplate structures are provided for use with a field emitter in display panels. Processes for making the structures are also disclosed. The backplate structures are made of a plurality of electrodes separated by one or more patterned layers of a dielectric composition, each said patterned layer being formed by firing a thick film dielectric composition which has been patterned by diffusion patterning.

5 Claims, 3 Drawing Sheets

FIELD EMITTER CATHODE BACKPLATE STRUCTURES FOR DISPLAY PANELS

CROSS-REFERENCE TO RELATED DOCUMENTS

The application is a continuation of application Ser. No. 09/381,540, filed on Sep. 21, 1999, now abandoned which is a 35 U.S.C. § 371 filing of International application No. PCT/US98/05543, filed on Mar. 19, 1998 and claims the benefit of Provisional application No. 60/041,696, filed on Mar. 25, 1997.

FIELD OF THE INVENTION

The invention generally relates to multilayer cathode backplate structures for use with a field emitter in a display panel and processes for making the structures. In particular, the invention relates to multilayer cathode backplate structures comprised of a plurality of electrodes separated by one or more patterned layers of a dielectric composition.

BACKGROUND OF THE INVENTION

Field emission electron sources, often referred to as field emission materials or field emitters, can be used in a variety of electronic applications, e.g., vacuum electronic devices, flat panel computer and television displays, emission gate amplifiers, and klystrons and in lighting.

Display screens are used in a wide variety of applications such as home and commercial televisions, laptop and desktop computers and indoor and outdoor advertising and information presentations. Flat panel displays are only a few inches thick in contrast to the deep cathode ray tube monitors found on most televisions and desktop computers. Flat panel displays are a necessity for laptop computers, but also provide advantages in weight and size for many of the other applications. Currently, laptop computer flat panel displays use liquid crystals which can be switched from a transparent state to an opaque one by the application of small electrical signals. It is difficult to reliably produce these displays in sizes larger than that suitable for laptop computers.

Plasma displays have been proposed as an alternative to liquid crystal displays. A plasma display uses tiny cells of electrically charged gases to produce an image and requires relatively large electrical power to operate.

Flat panel displays having a cathode using a field emission electron source, i.e., a field emission material or field emitter, and a phosphor capable of emitting light upon bombardment by electrons emitted by the field emitter have been proposed. Such displays have the potential for providing the visual display advantages of the conventional cathode ray tube and the depth, weight and power consumption advantages of the other flat panel displays. U.S. Pat. Nos. 4,857,799 and 5,015,912 disclose matrix-addressed flat panel displays using micro-tip cathodes constructed of tungsten, molybdenum or silicon. WO 94-15352, WO 94-15350 and WO 94-28571 disclose flat panel displays wherein the cathodes have relatively flat emission surfaces.

However, in view of the above, there is a need for field emitter cathode backplate structures for panel displays that have control gate electrodes in proximity to the field emitter and that can be reliably produced in a large size and in quantity with the necessary precision required. Other objects and advantages of the present invention will become apparent to those skilled in the art upon reference to the attached drawings and to the detailed description of the invention which hereinafter follows.

SUMMARY OF THE INVENTION

The invention provides multilayer cathode backplate structures for use with a field emitter in a display panel (e.g., flat panel display) and processes for making the structures.

In particular, the invention provides a multilayer cathode backplate structure for use with a field emitter in a display panel comprised of a plurality of electrodes separated by one or more patterned layers of dielectric each of which is formed by firing a thick film dielectric composition which has been patterned by diffusion patterning.

The invention also provides a multilayer cathode backplate structure for use with a field emitter in a display panel comprised of a plurality of electrodes separated by one or more patterned layers of dielectric each of which is formed by firing a thick film photoprintable composition which has been exposed patternwise to actinic radiation and developed.

The invention also provides a multilayer cathode backplate structure for use with a field emitter in a display panel comprised of a plurality of electrodes separated by one or more patterned layers of dielectric each of which is formed by firing a high strength glass/ceramic tape which has been patterned.

The multilayer cathode backplate structures are useful in flat panel computer and television displays and other large screen applications. As used herein, the term "display panel" embraces planar and curved surfaces as well as other possible geometries.

DETAILED DESCRIPTION OF THE PREFERRED EMBODIMENTS

Figure 1A:
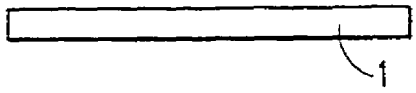
FIGS. 1(*a–i*) shows a process used for constructing a multilayer cathode backplate structure using diffusion patterning techniques.
Figure 1B:
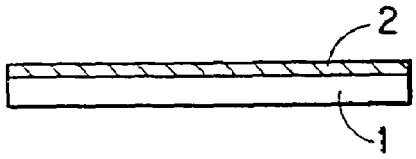
Figure 1C:
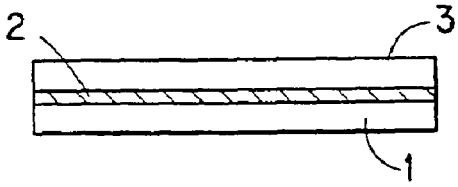
Figure 1D:
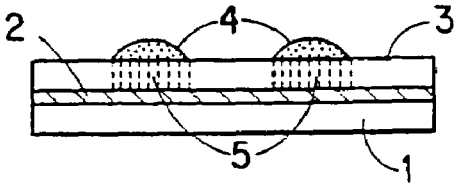
Figure 1E:
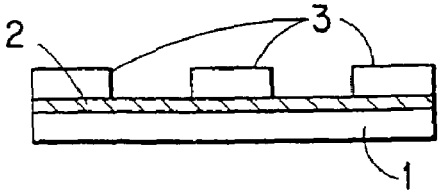
Figure 1F:
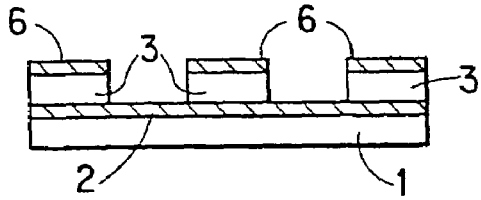
Figure 1G:
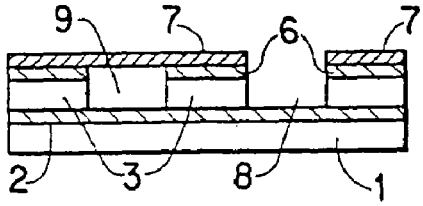
Figure 1H:
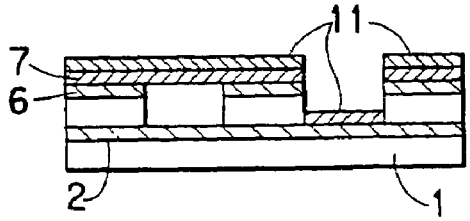
Figure 1I:
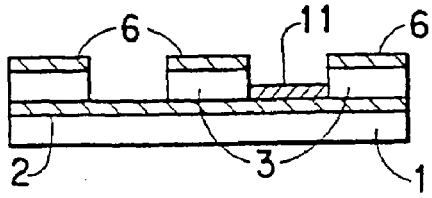

The multilayer construction of the cathode backplate structure of this invention makes it possible to position gate electrodes very close to the field emitter and thereby provide necessary control of the emission. The construction of the cathode backplate structure makes use of one or more of the following technologies: diffusion patterning techniques; photoprintable compositions; and high strength glass/ceramic tape and screen printing. These technologies lend themselves to making large size cathode backplates and to large-scale production with reproducible results. Resistors and other circuit elements can be incorporated into the structure, e.g., by screen printing or other patterning where appropriate.

The diffusion techniques that can be used in preparing the multilayer cathode backplate structure result in a patterned dielectric layer and are described in U.S. Pat. No. 5,032,216, U.S. Pat. No. 5,209,814, U.S. Pat. No. 5,260,163, U.S. Pat. No. 5,275,689 and U.S. Pat. No. 5,306,756, the entire contents of which are incorporated herein. The preferred diffusion technique is the Diffusion Patterning™ system (commercially available from E. I. du Pont de Nemours and Company, Wilmington, Del.). The process is based on the chemical reaction between a dried dielectric layer which contains acidic acrylic polymer and an imaging paste which contains a complex organic base and which is deposited, preferably by screen printing, on the dielectric layer. The compositions of the dielectric layer and the imaging paste are chosen so that, upon heating, there is diffusion of the imaging paste into the dielectric layer. As a result, this portion of the dielectric layer becomes water soluble and can be washed away with an aqueous solution, thereby forming a patterned dielectric layer. The location of the imaging paste defines the location at which the dielectric layer is removed. The patterned dielectric is then fired. Currently, typical thicknesses of the fired layer are about 15–20 μm. The process can be repeated to form thicker layers. Thinner layers have been demonstrated and would also be useful in the invention.

Photoprintable compositions incorporate photosensitive polymers. Such compositions are described in U.S. Pat. No. 4,598,037, U.S. Pat. No. 4,726,877, U.S. Pat. No. 4,753,865, U.S. Pat. No. 4,908,296, U.S. Pat. No. 4,912,019, U.S. Pat. No. 4,925,771, U.S. Pat. No. 4,959,295, U.S. Pat. No. 5,032,478, U.S. Pat. No. 5,032,490, U.S. Pat. No. 5,035,980 and U.S. Pat. No. 5,047,313, the entire contents of which are incorporated herein. The preferred photoprintable composition that can be used in preparing the multilayer cathode backplate structure is FODEL® dielectric paste (commercially available from E. I. du Pont de Nemours and Company, Wilmington, Del.). The dielectric paste is printed onto the substrate and dried. Currently, such a layer, when fired, results in a dielectric layer about 8–10 μm thick. Thinner layers have been demonstrated and would also be useful in the invention. If a thicker layer is desired, a second layer of dielectric paste can be printed onto the first layer and dried. Patterning is achieved by exposing the photoprintable composition to ultraviolet light through a phototool. The unexposed areas of the coating are removed with an aqueous solution in the development step of the process. The remaining exposed regions of the coating are then fired. To obtain a final fired thickness of about 40–45 μm, the print/dry, print/dry, expose, develop and fire sequence is repeated one additional time. This technology can also be applied to form patterned conductors when photoprintable conductor paste is used.

The high strength glass/ceramic tape that can be used in preparing patterned dielectric layers on the multilayer cathode backplate structure is a dielectric composition that can be fired at relatively low temperatures, thereby permitting the use of conductive materials such as gold, silver, copper and palladium. Such tape is described in U.S. Pat. No. 4,752,531, the entire contents of which are incorporated herein. The preferred tape is ceramic GREEN TAPE® (commercially available from E. I. du Pont de Nemours and Company, Wilmington, Del.). This tape is blanked to size and registration holes, vias and other patterning can be formed by punching or drilling. Conductors can be patterned onto the tape, e.g., by screen printing. Various layers of tape can be processed in this way. The tape layers are then registered, laminated and co-fired. Typically, the dielectric layers produced are about 90–210 μm thick after firing depending on the particular GREEN TAPE® used, but thinner layers can be produced using thinner GREEN TAPE®.

As noted before, the display panel can be planar or curved and the multilayer cathode backplate structure will be planar or curved accordingly. The non-limiting examples and figures illustrating the invention describe planar multilayer backplate structures. Curved multilayer cathode backplate structures will have the same multilayer construction.

The multilayer construction of the cathode backplate structure provides flexibility in design and can be used with field emitters in various forms. The field emitter can be in the form of a layer, which preferably has been patterned, or it can be selectively deposited. The field emitter can be introduced during the construction of the multilayer cathode backplate or can be formed on the completed multilayer cathode backplate. The field emitter can also be in fibrous form. Various fiber or fiber-like geometries are possible in forming a fibrous field emitter. By "fiber" is meant an object with one dimension substantially greater than the other two dimensions. By "fiber-like" is meant any structure resembling a fiber even though that structure may not be moveable and able to support its own weight. For example, certain "fiber-like" structures, typically less than 10 μm in diameter, could be created directly on the cathode electrode. Fibers can be bundled together to form a multiple filament fiber.

Preferably, the field emitter is diamond, diamond-like carbon or glassy carbon according to U.S. Pat. No. 5,578,901, the entire contents of which are incorporated herein.

Figure 2A:
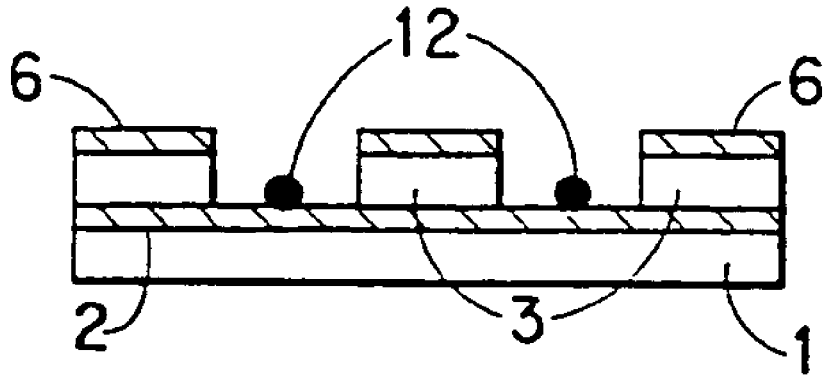
FIGS. 2(*a–b*) shows the use of a multilayer cathode backplate structure shown in FIG. 1 with a fibrous cathode.
Figure 2B:
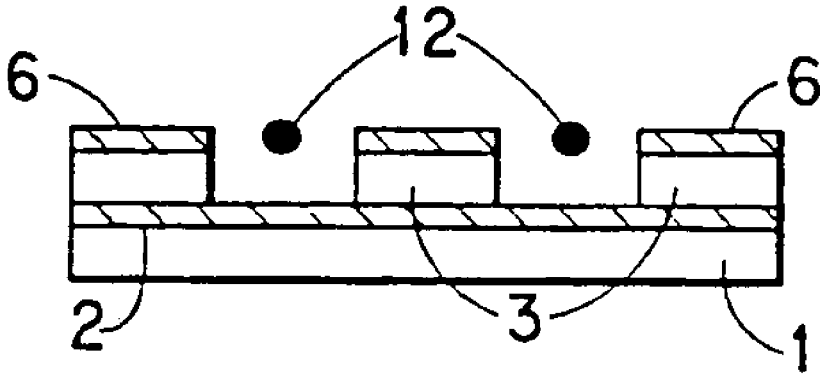
Figure 3A:
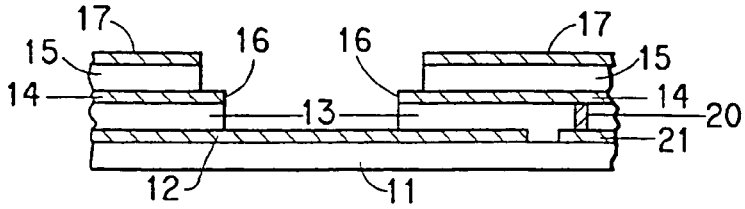
FIGS. 3(*a–d*) shows a process used for constructing a multilayer cathode backplate structure using a high strength glass/ceramic tape.
Figure 3B:
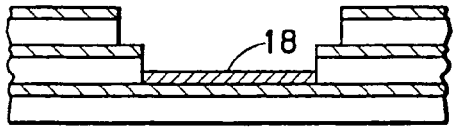
Figure 3C:
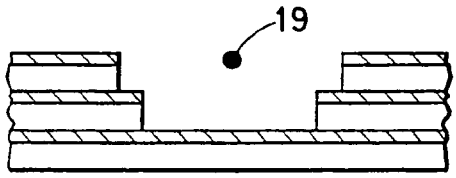
Figure 3D:
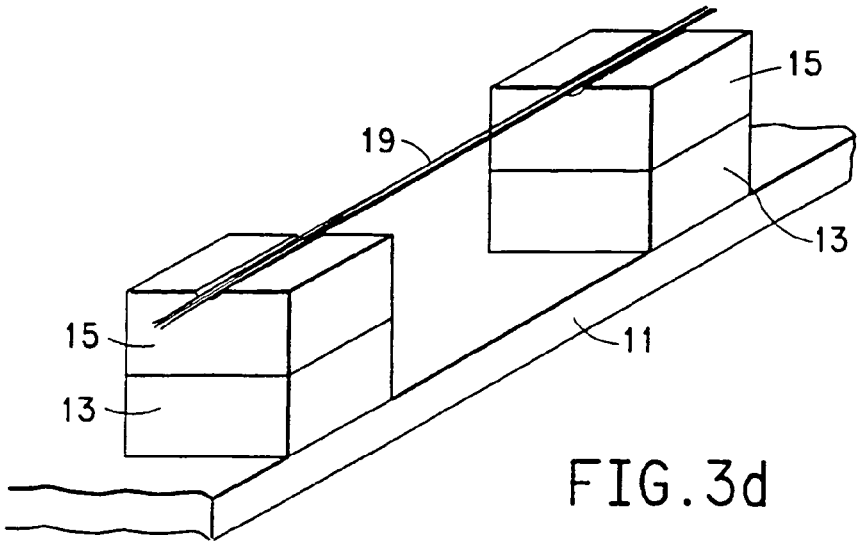

A process for constructing a multilayer cathode backplate structure with a planar patterned field emitter using the Diffusion Patterning™ system is shown as a series of steps in FIG. 1. As shown in FIG. 1(*a*), there is a base 1 of soda glass, borosilicate glass, glass ceramic, a dielectric material or a high strength glass/ceramic tape, e.g., GREEN TAPE®. A layer of an electrical conductor 2 is deposited onto the base, e.g., by screen printing, FIG. 1(*b*). This conductor serves as the cathode electrode. The conductor can be a continuous layer or patterned as dictated by the scheme used to address the emitter. A layer of the Diffusion Patterning™ dielectric 3 is printed as shown in FIG. 1(*c*) and is then dried. Diffusion Patterning™ imaging paste 4 is then screen printed onto the Diffusion Patterning™ dielectric 3 in a pattern corresponding to the portions of the dielectric material 3 that is to be removed as shown in FIG. 1(*d*). The patterned imaging paste 4 is then heated to effect diffusion of the imaging paste 4 into the portions 5 of the dielectric 3. The portions 5 of the dielectric layer 3 are then washed away with water leaving exposed lengths of cathode electrode as shown in FIG. 1(*e*). The structure is then fired. The dielectric print/dry/diffuse/develop/fire sequence can be repeated to produce a thicker dielectric. As shown in FIG. 1(*e*), an electrical conductor 6 is patterned, e.g., screen printed, onto the fired dielectric 3 according to a pre-determined pattern and leaving the portions of the cathode electrode exposed. The electrical conductor 6 serves as a gate or control electrode. The resulting product is a multilayer cathode backplate structure with patterned electrodes and dielectric. The field emitter material or a precursor of the field emitter material can then be deposited onto some or all of the exposed cathode electrode depending on the design. This can be accomplished by placing a resist 7, e.g., RISTON® (commercially available from E. I. du Pont de Nemours and Company, Wilmington, Del.) over the structure and developing those portions of the resist corresponding to portions 8 of the cathode electrode 2 upon which it is desired to deposit the emitter material or a precursor of the emitter material. A dry film resist can "tent" the exposed areas 9 of the cathode electrode 2, if any, upon which no field emitter material is desired (see FIG. 1(*g*)). The field emitter material or a precursor of the field emitter material 11 is then deposited onto the structure as shown in FIG. 1(*h*). The field emitter material is then treated if necessary to improve emission or, if a precursor of the field emitter material is used, the precursor is processed to form the field emitter material which is then treated if necessary to improve emission. The resist 7 is then stripped using well-known techniques and the resulting multilayer cathode backplate structure with the field emitter material in place is shown in FIG. 1(*i*). If a fibrous cathode is to be used, the fibrous cathode 12 can be placed directly onto the exposed cathode electrode of the structure of FIG. 1(*f*) as shown in FIG. 2(*a*) or suspended above the cathode electrode from posts of dielectric at designated positions along the length of the fibrous cathode or from peaks of an undulating dielectric surface either of which can be formed by the Diffusion Patterning™ process depicted in FIGS. 1(*c*) and (*d*) and the subsequent aqueous solution wash. The fibrous cathode is positioned then as shown in FIG. 2(*b*). Emission is from the portions of the fibrous cathode suspended between the posts or peaks of the dielectric.

Alternatively, the structure described above can be constructed using a FODEL® photoprintable ceramic coating composition in place of the Diffusion Patterning™ system materials. A coating of the FODEL® dielectric paste is screen printed onto the cathode electrode shown in FIG. 1(*c*). The coating is then subjected to actinic radiation, e.g., ultraviolet light, through a phototool to expose those portions of the coating where a dielectric layer is desired. A gate electrode can be deposited as described above. The unexposed portions of the coating are washed away with an aqueous solution and the structure then fired to provide a structure essentially the same as that shown in FIG. 1(*f*). Subsequent steps can be performed as described above.

The structure described above can be constructed using ceramic GREEN TAPE®. The ceramic GREEN TAPE® is punched or drilled with the appropriate pattern desired for the dielectric before the gate electrode is deposited on it as described above. The ceramic GREEN TAPE® is laminated to the base containing the cathode electrode and the structure fired to provide a structure essentially the same as that shown in FIG. 1(*f*). Subsequent steps can be performed as described above.

It may be advantageous to have additional electrodes to control emission. They allow the use of lower emission voltages on the gate electrode and provide higher acceleration voltages. They also provide a means to adjust the field pattern and the emission and to focus the emitted electrons. Ceramic GREEN TAPE® is especially useful in constructing a multilayer cathode backplate structure with multiple control electrodes. The base 11 of FIG. 3(*a*) can be soda glass, borosilicate glass, glass ceramic or a dielectric material, but preferably is ceramic GREEN TAPE®. A layer of an electrical conductor 12 is deposited onto the base, e.g., by screen printing, by using a photopatterning material such as FODEL® conductor paste. This conductor serves as the cathode electrode and can be patterned or continuous. If patterned, portions of this conductor that are electrically isolated from the portions serving as the cathode electrode can be used as busses for supplying different voltages to the other electrodes and vias can be formed in the ceramic GREEN TAPE® and filled with conductor to provide connection between a given buss and the appropriate electrode. As an example, via 20 and buss 21 are shown. A second ceramic GREEN TAPE™ layer 13 is punched or drilled to form channels in which to place the field emitter and to form vias and placed on the cathode electrode. An electrical conductor 14 is formed on layer 13 according to a predetermined pattern. The electrical conductor 14 serves as a control electrode. If an additional control electrode is desired, a third ceramic GREEN TAPE® layer 15 is punched or drilled to form channels in which to place the field emitter and to form vias and placed on electrical conductor 14. Layer 15 can completely cover the planar surface of electrical conductor 14 leaving only edge 16 exposed or can be set back to expose more of electrical conductor 14 as shown in FIG. 3(*a*). An electrical conductor 17 serving as the additional control or focus electrode is formed on layer 15 according to a predetermined pattern. Additional electrodes can be constructed in a similar manner. Each ceramic GREEN TAPE® layer is made individually. They are then registered, laminated and fired to form the multilayer cathode backplate structure with patterned electrodes and dielectric shown in FIG. 3(*a*). The field emitter material or a precursor of the field emitter material 18 is then deposited onto the structure as shown in FIG. 3(*b*). The field emitter material is then treated if necessary to improve emission or if a precursor of the field emitter material is used, the precursor is processed to form the field emitter material which is then treated if necessary to improve emission. If a fibrous cathode is to be used, the fibrous cathode 19 can be placed directly onto the exposed cathode electrode of the fired structure of FIG. 3(*a*) or suspended above the cathode electrode as shown in FIG. 3(*c*). The fibrous cathode can be suspended from saddles of an undulating dielectric layer formed with ceramic GREEN TAPE® layer 13 and GREEN TAPE® layer 15 at designated positions along the length of the fibrous cathode as illustrated in FIG. 3(*d*). Alternatively the fibrous cathode can be suspended from saddles of dielectric formed with ceramic GREEN TAPE® layer 13.

Although particular embodiments of the present invention have been described in the foregoing description, it will be understood by those skilled in the art that the invention is capable of numerous modifications, substitutions and rearrangements without departing from the spirit or essential attributes of the invention. Reference should be made to the appended claims, rather than to the foregoing specification, as indicating the scope of the invention.

The invention claimed is:

1. A method for making a multi-layer cathode backplate structure, comprising the steps of:

providing a substrate;

forming a cathode electrode by depositing a layer of an electrical conductor onto the substrate;

selectively printing a layer of thick film dielectric material onto the cathode electrode;

drying the layer of thick film dielectric material;

selectively printing a layer of imaging paste onto the layer of dielectric material;

heating the layer of dielectric material to effect diffusion of the imaging paste into the layer of dielectric material;

removing portions of the dielectric material into which the imaging paste has been diffused and leaving exposed portions of the cathode electrode, wherein a plurality of cathode electrodes separated by a dielectric material are formed;

firing the structure; and depositing a field emitter material onto at least a portion of the plurality of cathode electrodes.

2. The method of claim 1, wherein the step of selectively printing a layer of dielectric material comprises screen printing.

3. The method of claim 1, wherein the step of selectively printing a layer of imaging paste comprises screen printing.

4. The method of claim 1, wherein the step of developing is aqueous-based.

5. The method of claim 1, wherein the field emitter material comprises a precursor field emitter material.

* * * * *